US006256889B1

(12) United States Patent
Zuro

(10) Patent No.: US 6,256,889 B1
(45) **Date of Patent: *Jul. 10, 2001**

(54) AUTO GLASS REPLACEMENT TOOL

(75) Inventor: Mark E. Zuro, Salt Lake City, UT (US)

(73) Assignee: Michigan Tool Design, Farmington Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/220,131

(22) Filed: Dec. 23, 1998

(51) Int. Cl.[7] ..... B26B 5/00
(52) U.S. Cl. ..... 30/339; 30/314
(58) Field of Search ..... 30/339, 335, 314; 279/30

(56) References Cited

U.S. PATENT DOCUMENTS

| | | | | |
|---|---|---|---|---|
| 1,583,967 | * | 5/1926 | Epps, Jr. | 30/339 |
| 1,914,153 | * | 6/1933 | Ogden | 30/339 |
| 2,431,118 | * | 11/1947 | Heigle | 30/339 |
| 3,187,431 | * | 6/1965 | Mattes | 30/339 |
| 3,195,232 | | 7/1965 | Toth | 30/169 |
| 3,673,383 | | 6/1972 | Sofia | 30/312 |
| 3,750,283 | | 8/1973 | Hoffman | 30/339 |
| 3,845,554 | | 11/1974 | Joanis et al. | 30/339 |
| 3,924,327 | * | 12/1975 | Edwards | 30/277 |
| 4,080,734 | | 3/1978 | Barbour | 30/123 |
| 4,215,475 | * | 8/1980 | Morford et al. | 30/272.1 |
| 4,481,059 | | 11/1984 | Steck | 156/254 |
| 4,694,576 | | 9/1987 | Cothery | 30/280 |
| 4,700,478 | | 10/1987 | Mezger et al. | 30/314 |
| 4,819,531 | | 4/1989 | Lawhon | 30/314 |
| 5,085,415 | | 2/1992 | Shaver | 269/69 |
| 5,190,604 | | 3/1993 | Shaver | 156/108 |
| 5,309,805 | | 5/1994 | Mezger et al. | 30/314 |
| 5,398,946 | * | 3/1995 | Quiring | 279/30 |
| 5,479,689 | | 1/1996 | Schmit et al. | 29/426.4 |
| 5,784,788 | * | 7/1998 | Cothery | 30/294 |
| 5,826,342 | | 10/1998 | Zuro | 30/279.2 |
| 5,903,983 | * | 5/1999 | Jungmann et al. | 30/392 |

OTHER PUBLICATIONS

Equalizer Industries, Inc., Equalizer 1998 Catalog, pp. 21–23.

Reid Manufacturing Company Incorporated Catalog, pp. 3, 8 No Date Shown.

* cited by examiner

*Primary Examiner*—Kenneth E. Peterson
*Assistant Examiner*—Stephen Choi
(74) *Attorney, Agent, or Firm*—Gifford, Krass, Groh, Sprinkle, Anderson & Citkowski, P.C.

(57) ABSTRACT

A tool for cutting the sealant surrounding a windshield of a vehicle comprises a handle for gripping by a user to which a blade is removably attached. In particular, the blade is received in a blade holder portion forming a channel for receiving the blade and holding a substantial portion of the sides of the blade. In addition, the blade can be quickly removed and replaced by manually actuating a blade release mechanism. The blade release mechanism is also configured to automatically engage a blade and secure the blade relative to the blade holder when the blade is properly inserted into the blade holder. A pull handle is secured relative to an end of the blade holder as with a cable pivotally mounted to the end of the blade holder at a position advantageous for applying a force to the blade when cutting the sealant surround the windshield of a vehicle.

7 Claims, 4 Drawing Sheets

AUTO GLASS REPLACEMENT TOOL

BACKGROUND

1. Field of the Invention

This invention relates generally to a tool for cutting the sealant from around the windshield of a vehicle when windshield replacement is desired, and more specifically to such a tool which includes a blade release mechanism for allowing quick release of a worn or broken blade and quick engagement of a new blade and which further provides a blade holder that allows substantial forces to be applied to the blade without substantial flexing of the blade relative to the blade holder.

2. Background of the Invention

Automotive vehicle windshields are typically held in place in the vehicle either by a urethane adhesive (applied directly to the vehicle) or by at least a partially resilient molding or gasket fitted in the windshield opening of the vehicle body and secured to the body. The gasket is typically formed to include an inwardly facing channel for receiving the edge of the windshield and preventing the windshield from being pushed either outwardly from the vehicle or inwardly. To further secure the windshield in the channel of the molding or gasket, an adhesive, sealant or bonding material is placed in the channel either before or after the windshield is installed to thus further secure the windshield in place in the gasket.

Because windshields become broken or cracked, it is often necessary from time to time to remove the windshield from a vehicle to replace it or to repair it. Then, either a new windshield is installed or the repaired windshield is reinstalled. In order to remove a windshield, it is necessary to cut or sever the bond between the windshield and the vehicle or windshield and the molding, as the case may be. A number of tools have been suggested for performing this cutting function. Typically, such tools include a blade extending outwardly from a handle for a short distance and then forming a right angle to the tip of the blade. The tip of the blade is inserted between the windshield and the vehicle or between the windshield and the molding, as the case may be. The blade is then pulled along the outer edge of the windshield from the outside of the vehicle to thereby sever the bond holding the windshield to the vehicle to allow the windshield to be removed.

When employing such a tool to cut the windshield from the vehicle, tremendous force is required to pull the blade along the outer edge of the windshield, making it difficult to maintain the blade in the proper cutting orientation, that is, to prevent the blade from wandering as it cuts. As such, many tools are provided with a pull handle that is attached directly to the blade with a cable or to the blade housing proximate where the blade exits the handle. In addition, because of the tremendous forces and stresses applied to the blade, it is common for the blade to fracture requiring replacement. One of the best tools for cutting the sealant from around a windshield is comprised of a cylindrical handle having an elongate slot formed therein for receiving a blade therein. Industry standard blades include three holes formed in the base or retaining portion thereof. The first two holes are secured to the handle with two externally threaded screws to hold the blade relative to the handle and to prevent the blade from rotating relative to the handle. A blade pulling handle is attached with a cable directly to the third hole in the blade. The third hole is positioned near the cutting portion of the blade to allow the pull handle attachment structure to clear the molding and windshield when the blade is inserted thereinbetween and to reduce the possibility that the pull handle attachment structure will contact the surface of the vehicle. While such a tool tends to perform well, it is very time consuming to replace the blade of such a device. Specifically, the two screws holding the blade to the handle must be removed as well as the pull handle attachment structure, and once a new blade is reinserted, the screws and pull handle attachment structure must be replaced.

Thus, it has been desirable to provide such a tool that allows for quick replacement of broken blades. One such tool that attempts to address these problems is described in U.S. Pat. No. 5,784,788 to Cothery. Cothery discloses a windshield replacement tool that allows for quick replacement of blades as well as a blade pull handle that is secured to the blade retaining member. However, the Cothery device has many drawbacks. To obtain enough clearance between the tool and the body of the vehicle to reduce the potential for scratching the paint of the vehicle, Cothery requires non-industry standard blades to be utilized, thus requiring special blades to be purchased. In addition, because of the use of the longer than standard distance between the point where the blade exits the handle and the ninety degree bend in the blade, the blade of Cothery tends to flex and thus wander as the blade is pulled around the windshield making it more difficult to cut and more likely that the blade will break. Moreover, because the cable of the pull handle rotates relative to the handle at an angle relative to the plane defined by the blade, it is more difficult to keep the blade cutting in a straight path. Finally, the cylindrical configuration of the blade holding portion and its blunt end makes it more likely that the end of the handle proximate the blade will contact the vehicle resulting in chipping or scraping of paint on the vehicle.

Thus, it would be advantageous to provide a vehicle windshield replacement tool that substantially rigidly holds the cutting end of the blade to prevent excessive flexing of the blade while cutting. It would also be advantageous to provide such a tool that allows the blade to be quickly removed and replaced when the blade becomes worn or broken. Moreover, it would be advantageous to provide such a tool that utilizes standard cutting blades available in the industry. It would also be advantageous to provide a vehicle windshield replacement tool that allows the tool, and more specifically the blade, to be pulled at a point directly on or adjacent the blade rather than on the handle. Furthermore, it would be advantageous to provide a vehicle windshield replacement tool that provides enough clearance between the handle and the vehicle body to reduce the possibility of damaging the surface of the vehicle. Additionally, it would be advantageous to provide a vehicle windshield replacement tool that is comprised of a plastic, nylon, or other non-metallic handle to reduce the possibility of scratching the paint of a vehicle if the handle contacts the paint during use of the tool.

SUMMARY OF THE INVENTION

Accordingly, a tool for cutting the adhesive or sealant surrounding a windshield enables quick changing of blades when desired or necessary and also prevents the blade from substantial flexing during the sealant cutting operation. Such a tool preferably comprises a handle configured for grasping by a user. A blade holder is secured relative to the handle and includes a right blade edge receiving portion or slot and a left blade edge receiving portion or slot. The right blade edge receiving portion and left blade edge receiving portion preferably comprise an elongate channel for receiving the retaining portion of the blade. A blade securing mechanism is associated with the blade holder and secures the retaining portion of the blade within the blade holder.

In another preferred embodiment, the blade holder has a first end secured relative to the handle and a second end. A blade pulling device is secured to the second end. The pulling device preferably comprises an elongate cable having a distal end and a proximal end, the distal end of the cable rotatably mounted proximate the second end of the blade holder such that rotational motion of the distal end is in a plane substantially parallel to a plane defined by the blade holder. A handle member is rotatably secured relative to the proximal end of the cable. Such a configuration allows a user to pull directly from a point on the blade while supporting the blade at that same point while providing the ability to quickly change the blade.

In another preferred embodiment, the blade holder includes an elongate plate having a right blade edge receiving portion or slot and the left blade edge receiving portion or slot for receiving and securing therein a blade for cutting the sealant from around the windshield of a vehicle.

In a preferred embodiment, the right and left blade edge receiving portions of the blade holder extend along a substantial portion of the length of the blade to a point proximate the cutting portion of the blade. By extending the blade holder in such a fashion, stresses applied to the blade during cutting are substantially reduced thus reducing the amount of flexing of the blade relative to the blade holder.

In yet another preferred embodiment, the right and left blade receiving portions each define an elongate channel extending along at least a portion of a right and a left side, respectively, of the blade holder. The channels have a width configured to substantially match the thickness of an industry standard blade and are spaced apart a distance to substantially match such a blade such that the blade is slidably engageable with the blade holder while the blade holder limits movement of the blade relative to the blade holder when the blade is secured thereto.

In still another preferred embodiment of the present invention, the blade securing mechanism comprises an elongate member associated with the handle being moveable between a first position and a second position. A blade engaging member is also provided that is actuatable by the elongate member and engages with a portion of the blade when the elongate member is in the first position and releases the blade when the elongate member is in a second position. Thus, the blade engaging member is moveable between a blade holding position when the elongate member is in the first position and a blade releasing position when the elongate member is in the second position. The blade engaging member at least partially resides within the aperture of the blade when the elongate member is in the first position and the blade engaging member at least partially resides within the first recess of the elongate member when the elongate member is in the second position.

In yet another preferred embodiment, a biasing member is provided for biasing the elongate member between the first position and the second position toward the first position.

In another preferred embodiment, the elongate member defines a first recess in an outer surface thereof such that the blade engaging member is held by the elongate member at least partially within an aperture formed in the blade when the elongate member is in the first position. The blade engaging member is further positioned at least partially within the first recess when the elongate member is in the second position to release the blade.

In still another preferred embodiment, the elongate member defines a second recess in the outer surface thereof, and a retaining member associated with the handle engages with the second recess, allowing the elongate member to move between the first position and the second position while being secured relative to the handle.

In yet another preferred embodiment, the handle defines a first bore extending at least partially into the handle for receiving the biasing member and the elongate member and a transverse bore extending from proximate the aperture in the blade to the elongate bore for receiving the blade engaging member. The first bore is configured to allow the blade retaining member to move from a blade engaging position to a blade releasing position as the elongate member moves from the first position to the second position, respectively.

In yet another preferred embodiment, the right blade edge receiving portion and the left blade receiving portion extend along a substantial portion of the retaining portion of the blade to prevent the retaining portion of the blade from flexing when a force is applied to the second end of the blade holder with the pulling device.

In still another preferred embodiment, only the cutting portion of the blade extends beyond the second end of the blade holder when the blade is secured within the blade holder.

In yet another preferred embodiment, a tool in accordance with the present invention includes a pair of blade retaining members for engaging with one or two apertures or holes provided in the blade. As such a blade having a width less than the width of the blade holder may be utilized without allowing the blade to rotate relative to the handle.

In use, the blade may be quickly replaced by simply depressing the elongate member thus causing the blade retaining member to release the blade. A new blade can then be inserted into the blade holder and automatically retained by the blade retaining member when the new blade is properly inserted.

BRIEF DESCRIPTION OF THE DRAWINGS

The above and other objects, features and advantages of the present invention will become apparent from a consideration of the following detailed description present in connection with the accompanying drawings in which.

DETAILED DESCRIPTION OF THE PREFERRED EMBODIMENTS

Figure 1:
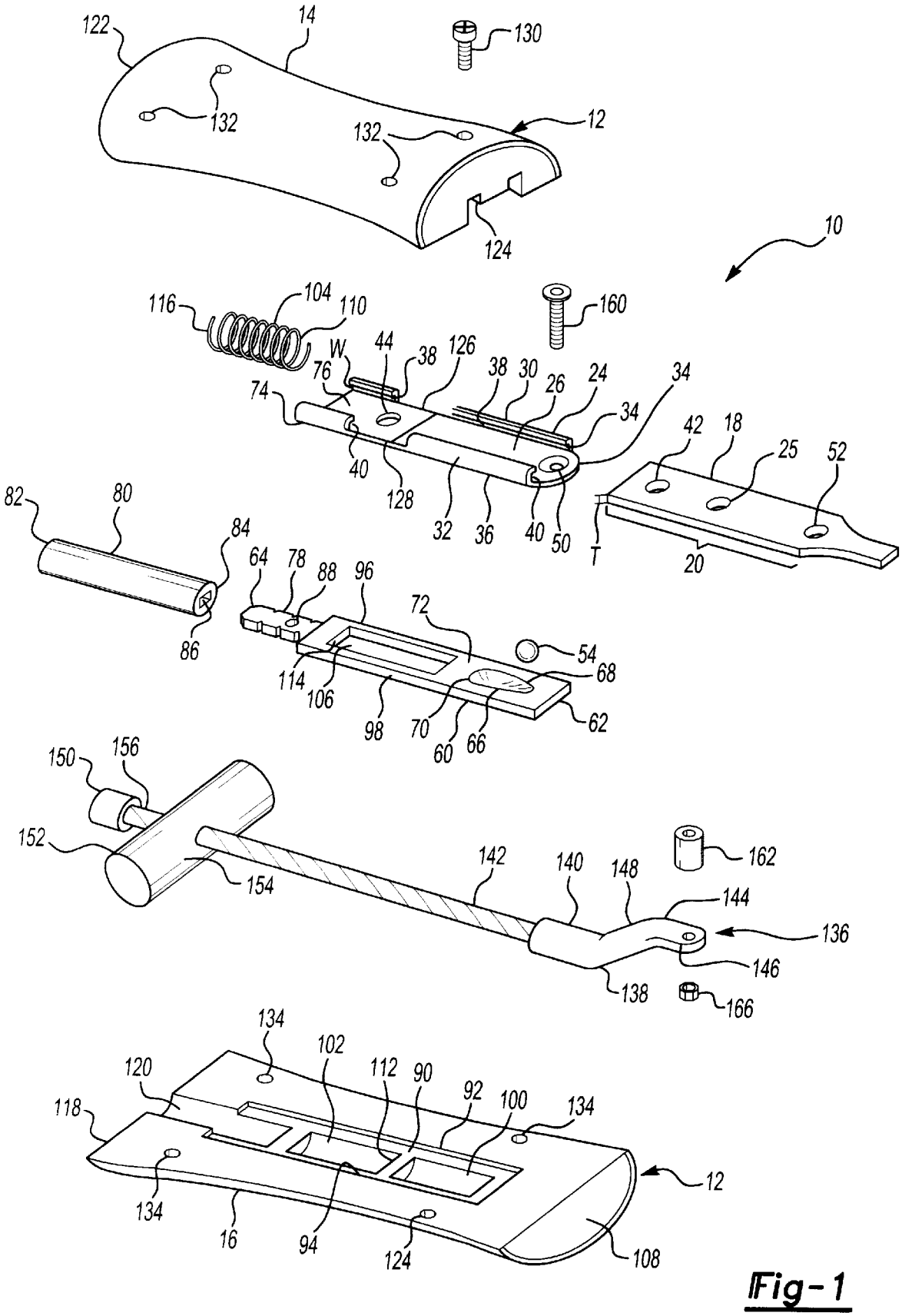
FIG. 1 is an exploded perspective view of a first preferred embodiment of a windshield replacement tool in accordance with the principles of the present invention.

Referring to FIG. 1, there is illustrated a preferred embodiment of a windshield replacement tool, generally indicated at 10, in an exploded view that allows a user to pull the tool 10 at a point directly adjacent the blade 18 while providing lateral support for the blade 18 at that point and allows the user to quickly change the blade 18 as desired. The tool 10 is comprised of a housing or handle portion 12 which includes a top portion 14 and a bottom portion 16 that are combined to form the handle 12. In accordance with the principles of the present invention, it is desirable to provide structural support for the blade 18. The blade is comprised of an attachment or retaining portion 20 and a cutting portion 22. Thus, it is desirable to provide a blade support structure or holder 24 that supports a substantial portion of the retaining portion 20 of the blade 18. The blade 18, which in this preferred embodiment is an industry standard blade that may be used with other windshield replacement tools known in the art, when used with such windshield replacement tools, often lacks support therefor from a position proximate the second aperture or hole 25 therein to the tip 28 of the cutting portion. As such, the blade 18 and, more particularly, the cutting portion 22 is allowed to flex in a direction substantially parallel to the longitudinal axis of the cutting portion 22 relative to the handle of the windshield replacement tool, making it difficult to control the direction of cutting when cutting sealant from around a windshield. Accordingly, the blade holder 24 is provided which is comprised of an elongate member or plate portion 26 having two elongate side portions 30 and 32 extending along a substantial length of the edges 34 and 36, respectively, of the plate portion 26. The side portions 30 and 32 have an "L" or "J" cross-sectional shape such that the side portions 30 and 32 and the plate portion 26 form elongate channels or slots 38 and 40 along the edges 34 and 36, respectively, of the plate portion 26. The slots 38 and 40 have a width W slightly larger than the thickness T of the blade 18 so as to allow sliding engagement of the blade holder 24 with the blade 18 yet limiting movement or flexing of the blade 18 in both lateral and transverse directions when the blade 18 is properly secured therein. When secured therein, the hole or aperture 42 provided in the blade 18 is substantially aligned with the opening, aperture, or hole 44 provided in the plate portion 26 of the blade holder 24 such that the distal end 46 of the blade holder 24 extends to proximate the transition portion 48 between the retaining portion 20 and the cutting portion 22 of the blade 18. More specifically, in this preferred embodiment, the countersunk hole 50 provided in the distal end 46 of the blade holder 24 substantially aligns with the third aperture or hole 52 provided in the blade 18. As such, the blade holder 24 provides structural support for a substantial portion of the retaining portion 20 of the blade 18. Moreover, because the blade holder is configured to be a relatively flat or thin member, the blade holder 24 provides little, if any, interference with the cutting operation. Preferably, the blade holder 24 is formed from a relatively flat segment of steel or other rigid or hardened material that is pressed by methods known in the art such that the holes 44 and 50 are punched through the plate portion 26, and the side portions 30 and 32 are formed by rolling or otherwise bending the side portions 30 and 32 into the "L" or "J" configuration as previously described. It is also contemplated that the blade holder 24 may be machined, cast or otherwise formed depending on the material used and the desired structural properties of the blade holder 24. Those skilled in the art, after understanding the principles of the present invention, will also appreciate that various modifications of the blade holder 24 may be made without departing from the spirit and scope of the present invention. For example, the side portions 30 and 32 could extend substantially or entirely over the plate portion 26 such that the blade holder 24 defines an elongate channel therethrough configured for receiving the blade 18 therein. Moreover, the side portions 30 and 32 may not be continuous along the length of the plate portion 26 as illustrated but may comprise a plurality of side portions with gaps or spaces thereinbetween.

As further illustrated in FIG. 1, the blade 18 is retained within the blade holder 24 with a blade retaining member 54, such as the ball bearing as shown or other spherical or non-spherical member(s) configured for insertion through the holes 44 and 42, that is, received in the hole 44 in the plate portion 26 of the blade holder 24 and at least partially into the hole 42 in the retaining portion 20 of the blade 18. When the blade retaining member 54 is held within the hole 42 of the blade 18, the blade 18 is prevented from being pulled from and pushed into the blade holder 24 even during rigorous usage of the blade 18 for cutting.

The blade retaining member 54 is held within the hole 44 in the blade holder 24 and the hole 42 of the blade 18 with an actuatable member 60 moveable between a first position and a second position. The actuatable member 60 is preferably formed from or formed into a plate that is made by pressing, machining, casting and/or molding. Thus, the actuatable member 60 comprises an elongated plate having a distal end 62 and a proximal end 64. Proximate the distal end 62, the actuatable member or plate 60 defines a divot or recess 66 therein. The recess 66 has a teardrop shape with the narrow portion 68 of the teardrop pointing substantially toward the distal end 62 of the plate 60 and the wider portion 70 of the teardrop nearest the proximal end 64 of the plate 60. The recess 66 provides a track or guide for causing the blade retaining member 54 to at least partially reside within the hole 42 of the blade 18 when the narrow portion 68 of the recess 66 is positioned beneath the blade retaining member 54, that is, when the plate 60 is in a first position, and for allowing the blade retaining member 54 to disengage from the hole 42 of the blade 18 when the plate 60 is in a second position such that the blade retaining member 54 is allowed to reside at least partially within the wider portion 70 of the recess 66. When assembled relative to the blade holder 24, the top surface 72 of the plate 60 is preferably in contact with the bottom surface 74 of the blade holder 24 such that the blade retaining member 54 is maintained in position relative to the hole 44 of the blade holder 24. Moreover, the upper handle portion 14 prevents the blade retaining member 54 from becoming disassociated from the hole 44 when the blade 18 is removed from the blade holder 24. Typically, the blade retaining member 54 will be supported within the hole 44 of the blade holder 24 by the narrow portion 68 of the recess 66 such that about half of the blade retaining member 54 will extend above the top surface 76 of the plate portion 26 of the blade holder 24. Moreover, the handle portion 14 will provide an abutment to prevent the blade retaining member 54 from extending more than about halfway above the surface 76.

The proximal end 64 of the plate 60 is provided with serrated end portion 78 for securing to a push button, knob, or, as illustrated, an elongate member 80 having a cylindrical shape. The proximal end 82 of the elongate member 80 is provided for pressing by a user and thus actuating the plate 60. In addition, the distal end 84 of the elongate member 80 is provided with a cavity 86 configured for receiving the proximal end 64 and more specifically the serrated end portion 78 of the plate 60. The elongate member 80 may be press-fit onto the serrated portion 78 or may be joined to the serrated portion 78 when the elongate member 80 is formed from a meltable material, such as a plastic or nylon material, by heating the serrated portion such that the walls defining the cavity 86 are caused to melt and thus form at least partially into and around the serrated portion 78 and at least partially into the hole 88 provided in the serrated portion. Those skilled in the art, however, will appreciate that attachment of the elongate member 80 to the distal end 64 of the plate 60 may be accomplished in many different ways whether with or without serrated surfaces. Moreover, those skilled in the art will appreciate that the plate 60 and elongate member 80 may be combined into a single integrated component.

As further illustrated in FIG. 1, the plate 60 is received within a first recess 90 formed within the bottom handle portion 16. The recess 90 defines an elongate track having side walls 92 and 94 for receiving and abutting against the edges 96 and 98, respectively, of the plate 60. When combined with the blade holder 24 and the handle portion 14, the plate 60 can slide longitudinally within the recess 90 but is substantially prevented from lateral movement.

The bottom handle portion 16 is also provided with a second recess 100, configured for receiving the recess or dimple 66 formed in the plate 60, and a third recess 102 for receiving a biasing member, such as the coil spring 104 as illustrated or other biasing devices known in the art. The plate 60 defines an opening or aperture 106 therein such that when the plate 60 is placed within the recess 90, the aperture 106 is positioned proximate the recess 102. The spring 104 is placed within the recess 102 and the aperture 106. As such, when the plate 60 is forced toward the distal end 108 of the handle portion 16, the distal end 110 of the spring abuts against the surface 112 defining the distal end of the recess 102, and the proximal surface 114 defining the aperture 106 abuts against the proximal end 116 of the spring 104. A similar recess (not shown) is provided in the handle portion 14 for receiving therein a portion of the spring 104. As such, the plate 60 is biased toward the proximal end 118 of the handle portion 16, maintaining the blade retaining member 54 proximate the narrow portion 68 of the recess 66 and thus in engagement with the hole 42 of the blade 18 when a blade is inserted within the blade holding member 24. A fourth recess 120 is provided in the proximal ends 118 and 122 of the handle portions 16 and 14, respectively for receiving therein at least a portion of the elongate member 80 for sliding engagement therewith when actuating the blade retaining member 54 by moving the plate 60.

Accordingly, the tool 10 is assembled by securing the elongate member 80 to the proximal end 64 of the plate 60 and placing the plate 60 within the recess 90. The spring 104 is inserted within the recess 102 and the aperture 106 of the plate 60. The blade holder 24 is placed within a recess 124 configured for substantially mating with the blade retaining member 54 in such a manner that the blade retaining member 54 is prevented from longitudinal movement relative to the handle portion 14. Such mating is preferably provide with providing a protrusion (not shown) within the handle portion 14 that engages with the cutout portions 126 and 128 defined by the blade holder 24 without interfering with insertion or removal of the blade 18 relative to the blade holder 24. The blade retaining member 54 is then inserted into the hole 44 in the blade retaining member 54 and the handle portions 14 and 16 are brought together. The handle portions 14 and 16 may be secured relative to one another with a plurality of threaded fasteners 130 for being received within counterbored holes 132 provided in the handle portion 14 and being threaded into bores 134 provided in the handle portion 16. Those skilled in the art will appreciate, however, that other means of attaching the handle portions 14 and 16 relative to one another may be employed such as be adhesive engagement, welding, riveting, and the like. When assembled, the blade holder 24 and thus a blade 18 secured therein extends from the handle proximate the longitudinal center of the handle 12 to help reduce torque on the blade 18 that may otherwise be generated if the blade 18 were positioned off center.

In order to further assist the cutting operation, the tool 10 is provided with a pull handle assembly, generally indicated at 136. The pull handle assembly 136 is pivotally attached to the blade holder 24 at the countersunk or recessed hole 50 to allow for clearance of the head of a screw. This countersunk or recessed hole 50 may have many different configurations depending on the type of screw to be employed. The pull handle 136 is comprised of a cable holder 138 having a sleeve portion 140 for attachment to an elongate flexible member 142 such as a cable and an attachment portion 144 having a transverse bore 146 extending therethrough interconnected by an interconnecting portion 148 for offsetting the sleeve portion 140 from the attachment portion 144. The sleeve portion 140 is preferably offset from the attachment portion 144 to provide clearance of the sleeve portion 140 when the sleeve portion 140 is rotated past the distal end 108 of the handle portion 16. The proximal end of the cable 142 is provided with an abutment bead 150 secured thereto for retaining a pull handle member 152 on the cable 142. The pull handle member 152 defines a transverse bore 154 therethrough for receiving the cable 142 therein. As such the handle 152 can slide along the cable 142. It is also contemplated that the pull handle 152 could be directly attached to the proximal end 156 of the cable 142. While this preferred embodiment illustrates a particular type of attachment of the pull handle 136 to the blade holder 24, those skilled in the art will appreciate after understanding the present invention that many other means for attaching the pull handle may be employed, such as a rivet, a pinned arrangement, or other devices that would allow pivoting or rotational movement.

The attachment portion 144 of the cable holder 138 is secured to the blade holder 24 with an externally threaded fastener 160, the head of which is inserted into the countersunk hole 50. A spacer or bearing 162 is placed on the fastener 160 and against the blade holder 24. The attachment portion 144 is then placed on the fastener 160 and secured thereto with an internally threaded fastener or nut 166, such as a self locking nut. The nut 166 is tightened to allow relatively free rotation of the handle 136 relative to the blade holder 24. Such a configuration of attachment of the pull handle 136 to the blade holder 24 allows for insertion and removal of the blade 18 without interference by the pull handle 136 and provides a means for pulling the blade 18 while cutting at a desired position, that is, proximate the hole 52 of the blade 18 such that the pulling force applied by the pull handle is as close to the cutting portion 22 of the blade 18 as practical. In addition, applying the pulling force at a position proximate the hole 52 as provided by the pull handle 136 in accordance with the present invention reduces the amount of torque that would otherwise be applied to the blade 18 if the pull handle 136 were otherwise attached.

In use, the blade 18 is inserted between the windshield of a vehicle and the molding and pulled with the handle 152 to cut the sealant between the windshield and the molding. As such, the handle 152 and thus the cutting portion 22 of the blade 18 is pointed toward the glass side and the upper handle portion 14 is on the vehicle side. Accordingly, the tool 10 must be configured to allow a certain amount of clearance between the distal end 108 of the handle 12 and the surface of the vehicle to prevent or substantially reduce the possibility of damaging the vehicle's surface (e.g., paint) when using the tool 10. The blade holder 24 provides support for the blade 18 along a substantial portion thereof but has a narrow profile such that it is highly unlikely that the blade holder 24 will cause any damage to the vehicle's surface when the tool 10 is being used. Because the handle portion 14 will extend over the vehicle's surface when using the tool 10, the distal end 108 of the handle portion 14 is the most likely part of the tool 10 that may contact the vehicle's surface during use. With the use of the blade holder 24 in accordance with the present invention, however, a handle 12 made from a softer material may be employed. For example, the handle 12 may be comprised of plastic, nylon, or some other non-abrasive material that is less likely to damage the surface of a vehicle if caused to be in contact therewith than a handle made of metal, such as aluminum or steel. Because the stresses and force of the blade 18 on the handle 12 will be contained within and absorbed by the blade holder 24, the handle 12 can be made from any suitable material without the possibility that the blade 18 causing the handle 12 to deform, wear or otherwise become misshapen during use of the tool.

Figure 2:
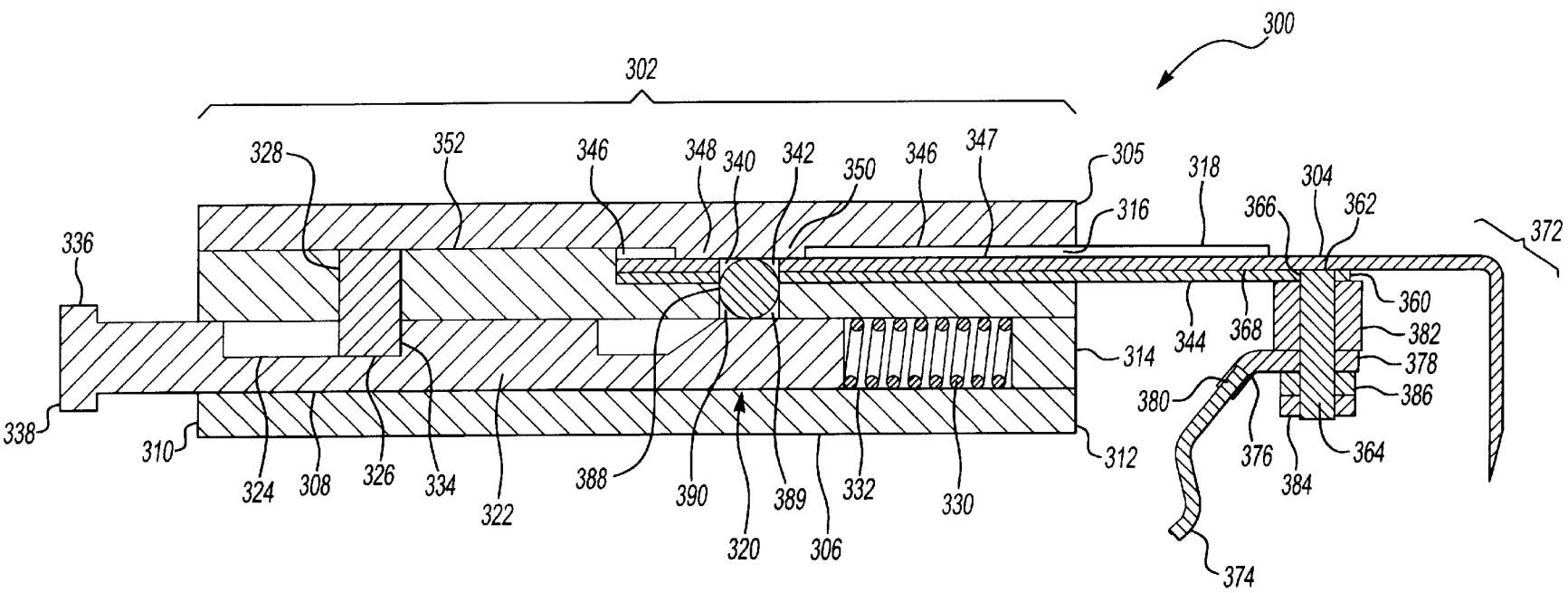
FIG. 2 is a cross-sectional side view of a second preferred embodiment of a windshield replacement tool in accordance with the principles of the present invention.

Referring now to FIG. 2, another preferred embodiment of a windshield replacement tool, generally indicated at 300, is illustrated. The tool 300 is comprised of a housing or handle portion 302 to which a blade 304 is secured relative thereto. The handle 302 includes a first handle portion 305 which is secured to a second handle portion 306 as with a plurality of threaded fasteners or screws (not shown). The first and second handle portions 305 and 306 also define thereinbetween a cavity or opening 316 configured for receiving and securing therein a blade holding mechanism or blade holder 318. In addition, the tool 300 is configured to allow quick release and replacement of blades 304 without requiring any disassembly of the tool 300, Accordingly, the tool 300 is provided with a blade securing mechanism, generally indicated at 320, configured for holding the blade in place while using the tool 300 to cut the sealant from around a windshield, and for allowing quick removal and replacement of blades 304 when desired. As such, the second handle portion 306 defines an elongate channel or bore 308 extending longitudinally therethrough from a proximal end 310 to a distal end 312 of the handle 302. A plug or abutment member 314 is provided in the distal end 312 of the bore 308 and is secured relative thereto. An elongate member, rod, or shaft 322 is configured to fit within the bore 308 such that lateral movement of the shaft 322 is reduced while allowing the shaft to slide in either direction within the bore 308. In this preferred embodiment, the shaft 322 and thus the bore 308 have circular cross-sections, but it is also contemplated that the shaft 322 and bore 308 may have any cross-sectional shape. The shaft 322 defines a first recess 324 for receiving a shaft retaining member 326 that is held in position relative to the second handle portion 306 as by being received within a recess or aperture 328 formed therein and sized and configured to hold the shaft retaining member 326 in a stationary position relative thereto. The recess 324 provided in the shaft 322, however, is longitudinally longer than the shaft retaining member 326. A biasing member 330, such as a coil spring, is provided between the plug 314 and the distal end 332 of the shaft 322 to as to bias the shaft 322 toward the proximal end 310 of the handle 302. As such, the recess 324 is defined by a first abutment surface 334 for retaining the shaft 322 within the bore 308 when the shaft 322 is not being forced by a user toward the distal end 312 of the handle portion 302. When the shaft 322 is forced toward the distal end 312 of the handle 302, the recess 324 allows the shaft 322 to move relative to the shaft retaining member 326. A knob 336 is provided on the proximal end 338 of the shaft 322 for depressing the shaft 322 into the bore 308 by a user.

When ready for cutting, the blade 304 is held within the blade holder 318 with the blade retaining or securing mechanism 320. More specifically, the blade 304 defines at least one recess, aperture, opening or hole 340 for receiving a blade retaining member 342 at least partially therein. The blade retaining member 342 is held in position relative to the handle 302 thus holding the blade 304 in position relative to the handle 302. The blade 304 is held within and is structurally supported by the blade holder 318 which is secured within the handle 302. As illustrated, the blade holder 318 is comprised of a bottom plate 344 for extending along and supporting a substantial portion of the retaining portion 347 of the blade 304. The bottom plate 344 of the blade holder 318 includes a pair of opposing sides, only one 346 of which is visible in the cross-sectional view, that essentially wraps around the longitudinal edges of the blade 304 thus providing both lateral and transverse support for the blade 304. In addition, a recess or gap 348 is formed in the sides 346 for receiving a protrusion 350 provided on the inner surface 352 of the first handle portion 305 such that the protrusion 350 and gap 348 combine in a tongue-and-groove arrangement for maintaining the blade holder 318 within the handle 300. The blade holder 318 extends a distance beyond the distal end 312 of the handle 302 such that the distal end 312 of the handle 302 does not interfere with the cutting operation.

The distal end 360 of the blade holder 318 is provided with a countersunk bore 362 for receiving a fastener 364 therein. Preferably, the fastener 364 is an externally threaded screw having a head 366 configured for being received within the countersunk or recessed bore 362 such that the head 366 does not protrude above the top surface 368 of the bottom plate 344 of the blade holder 318 and thus does not interfere with insertion or removal of the blade 304 into or out of the blade holder 318. The fastener 364 is provided to attach a pull handle (such as that described with reference to FIG. 1) for applying a force to the cutting portion 372 of the blade 304. The pull handle is secured to the fastener 364 as with a cable 374 or other flexible structure to which a substantial longitudinal force may be applied. The cable 374 is pivotally mounted to the blade holder 318 with a sleeve 376 that is pivotally mounted relative to the fastener 364 proximate a first end 378. The second end 380 of the sleeve 376 fits over the cable 374 and is secured thereto as by crimping or other means of mechanical attachment known in the art. The sleeve 376 is spaced from the back of the blade holder 318 with a spacer or bearing 382 disposed around the fastener 364. In addition, the sleeve 376 and bearing 382 are secured relative to the fastener 364 with a pair of internally threaded fasteners or nuts 384 and 386 that can be tightened relative to one another to hold their relative positions relative to the fastener 364 while allowing the sleeve 376 to relatively freely rotate relative to the blade holder 318. Of course, rivets or other means for attachment may be employed.

As previously indicated, the blade 304 is maintained in position in the longitudinal direction relative to the blade holder 318 with a blade retaining member 342 which is inserted through an aperture or hole 340 in the blade 304. The blade retaining member 342 is held in position relative to the handle 302 by a chamber 389 formed by an aperture or hole 388 defined by the bottom plate 344 of the blade holder 318 and the aperture or hole 390 defined by the second handle portion 306. The blade retaining member 342 is further held within the chamber 389 by the surface of the protrusion 350 of the first handle portion 305 and the outer surface of the shaft 322 when the shaft is in a first position as shown.

Figure 3:
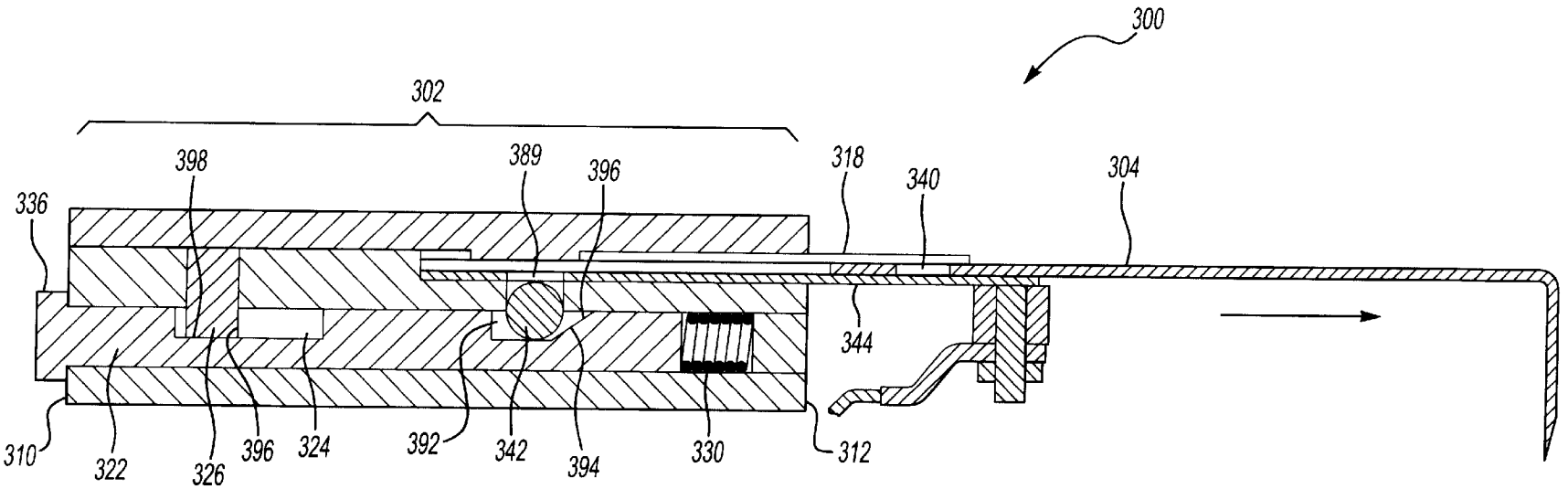
FIG. 3 is a cross-sectional side view of the windshield replacement tool illustrated in FIG. 2 in a configuration in which the cutting blade can be removed or replaced.

Referring now to FIG. 3, there is shown the tool 300 illustrated in FIG. 2 in which the blade 304 can be quickly and easily removed and replaced. More specifically, when the knob 336 of the shaft 322 is pressed such that the shaft 322 moves toward the distal end 312 of the handle 302, the spring 330 is compressed. As such, a second recess 392 formed in the shaft 322 is moved to a position that allows the blade retaining member 342 to move at least partially into the recess 392 and out of engagement with the hole 340 defined by the blade 304. Thus, the blade 304 can be removed from the blade holder 318.

When the knob 336 is depressed, the recess 324 in the shaft 322 moves relative to the shaft retaining member 326. The shaft retaining member 326, however, provides a bottom surface 396 which abuts against the bottom surface 398 of the recess 324. Preferably, the bottom surface 396 of the shaft retaining member 326 is relatively flat to engage with and abut against the relatively flat bottom surface 398 of the recess 324. With such an arrangement, the shaft 322 is prevented from rotating relative to the handle 302 by the shaft retaining member 326.

When the knob 336 is released, the sloped surface 394 defining the distal end 396 of the recess 392 forces the blade retaining member 342 back into the chamber 389. In the preferred embodiment, the blade retaining member 342 comprises a spherically shaped steel ball. As the shaft 322 is released and the coil spring 330 forces the shaft 322 toward the proximal end 310 of the handle 302, the ball 342 rolls along the surface 394 and is thus guided back into the chamber 389. When a new blade 304 is inserted into the blade holder 318, the knob 336 is depressed to allow the ball 342 to enter the recess 392 and released to engage with the hole 340 of the new blade. As such, the tool 300 provides for quick release of the blade 304 and quickly secures itself to a new blade 304.

Figure 4:
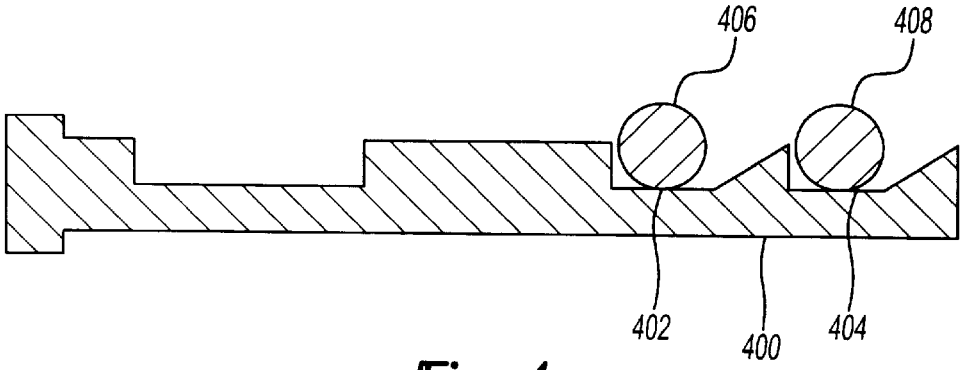
FIG. 4 is a cross-sectional side view of another preferred embodiment of a blade retaining device in accordance with the principles of the present invention.

It is also contemplated that a tool in accordance with the principles of the present invention may be comprised of an elongate shaft or blade retaining member actuation device 400, as shown in FIG. 4, that defines a pair of dimples or recesses 402 and 404 therein for receiving at least partially therein and for actuating a pair of blade retaining members 406 and 408, respectively. By employing a pair of blade retaining members 406 and 408 for alignment and engagement with a pair of holes or a single elongated slot or hole in the blade, blades of smaller widths that would otherwise not be securely held in place in a transverse direction relative to the blade holder, as when using a single blade retaining member, would be both longitudinally and transversely secure relative to the blade holder. As such, both blade retaining members 406 and 408 could be actuated by a single elongate member 400 having a pair of recesses 402 and 404 configured for actuating the pair of blade retaining members 406 and 408. As such, so long as the blade retaining members 406 and 408 are both engageable with a blade, a blade of any size may be securely held relative to the tool in order to perform cutting of a windshield sealant.

Figure 5:
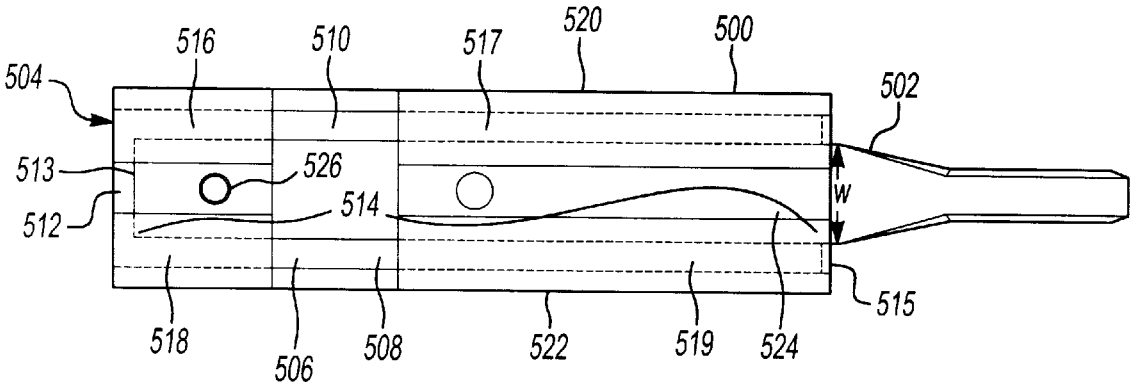
FIG. 5 illustrates a further preferred embodiment of a blade holder in accordance with the present invention.

FIG. 5 illustrates yet another preferred embodiment of a blade holder 500 in accordance with the principles of the present invention. Specifically, in order to be able to accommodate blades 502 having a width W that is smaller than the width of the channel or slot 504 defined by the blade holder 500, an blade adapter 506 is provided within the channel 504. The blade adapter 506 is comprised of two elongate sides 508 and 510 interconnected by an elongate back portion 512. The elongate back portion 512 abuts against the proximal end 513 of the blade 502 to maintain the blade adapter 506 within the blade holder 500 and is thus prevented from falling out of the distal end 515 of the blade holder 500 during use. Effectively, the elongate sides 508 and 510 and the back portion 512 form a substantially "U" shaped member configured for positioning and providing abutment surfaces for the retaining portion 514 of the blade 502 and thus hold the blade 502 relative to the longitudinal center of the blade holder 500. In addition, the channel 504 of the blade holder 500 is defined by top sections 516, 517, 518, and 519 that extend from the sides 520 and 522 of the blade holder 500 toward the longitudinal center of the blade holder 500 a distance sufficient to at least partially extend over the top surface 524 of the blade 502 in order to provide lateral support for the blade along a substantial portion of the retaining portion 514 of the blade 502. Accordingly, blades of various widths may be accommodated and adequately retained within the blade holder so long as the blade holder 500 provides some structure at least partially over the top surface 524 of such a blade 502. Moreover, it may be desirable to provide blade adapters 506 having side portions 508 and 510 of various widths such that when a blade 502 is inserted into the blade holder 500 and thus between the sides portions 508 and 510, the blade 502 is substantially prevented from moving a substantial distance transverse to the blade holder 500 during use of blade 502 for cutting.

Unlike the preferred embodiment illustrated with respect to FIG. 4, which utilized a pair of blade retaining members to secure a more narrow blade within the blade holder, the blade holder 500/blade adapter 506 combination shown in FIG. 5 allows the use of a single blade retaining member 526 such as the blade retaining members described and illustrated in other preferred embodiments herein. The blade holder 500 is configured in other ways similar to other preferred embodiments of the present invention and thus may be secured within a handle for grasping by a user. It is also contemplated that such a blade adapter may have utility with other windshield replacement tools known in the art such that those other tools may accommodate blades having different widths as well. Such blade adapters could be provided with side portions 508 and 510 that relatively snugly fit within a channel or opening provided for insertion of a blade. The side portions 508 and 510 would also be spaced apart a distance to relatively snugly receive a more narrow blade thereinbetween.

Figure 6:
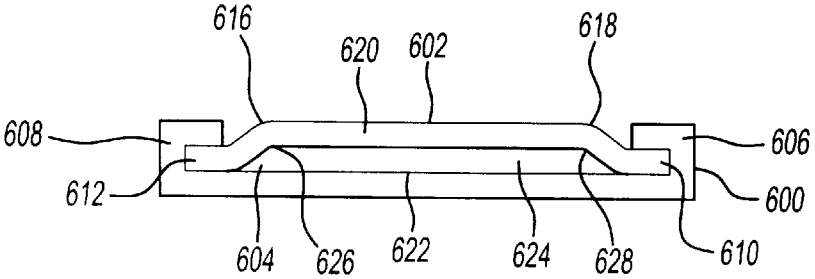
FIG. 6 illustrates a yet further preferred embodiment of a blade holder in accordance with the present invention.

FIG. 6 illustrates yet another preferred embodiment of a blade holder 600 and blade adapter 602 configured for holding a blade (not shown) therein of a width that is less than the width of the channel 604 defined by the right blade holder portion 606 and the left blade holder portion 608. The adapter 602 is comprised of an elongate plate that may be stamped or otherwise formed to define a first elongate side 610 and a second elongate side 612 configured to be received within the right blade holder portion 606 and the left blade holder portion 608, respectively. Bends 616 and 618 are provided in the adapter 602 to provide a raised mid portion 620 that is spaced above the inner surface 622 of the blade holder 600 to define a blade receiving channel 624 thereinbetween. Accordingly, a blade (not shown) having a width that is less than the distance between the right and left side portions 606 and 608, respectively, of the blade holder 600 may be accommodated. Preferably, the blade adapter 602 is configured such that the distance between the inner surfaces 626 and 628 is substantially the same as the width of the blade (not shown) while allowing such a blade to be inserted therein in order to provide transverse support for the blade relative to the blade holder 600. In addition, the mid portion 620 is preferably spaced from the inner surface 622 to substantially match the thickness of the blade (not shown) in order to provide lateral blade support during use and thus substantially limiting lateral movement of the blade (not shown) relative to the blade holder 600.

In the manner described, a simple, easy-to-use and yet effective windshield replacement tool is provided which, among other things, allows removal of a windshield with little or no damage to the exterior of the vehicle. Moreover, significant time is saved by providing a windshield removal tool in accordance with the principles of the present invention in which the blade is substantially supported and thus not easily broken during the cutting process and is quickly and easily replaceable when the blade becomes dull. Moreover, the windshield replacement tool in accordance with the principles of the present invention provides a tool in which a pull handle is attached thereto at a position and orientation that significantly reduces the amount of torque applied to the blade while cutting.

It should be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An apparatus for cutting a scalant surrounding a vehicle windshield, said apparatus comprising:

a handle configured to be grasped by a user and including an assembleable top and bottom;

a blade holder including a top surface, a bottom surface, a first side, a second side, a distal end and a proximal end, an aperture being formed in said blade holder between said top and bottom surfaces and said blade holder being fixedly secured between said assembled top and bottom of said handle so that said distal end projects a specified distance from said handle;

a blade including a first clongate attachment portion and a second cutting portion, an aperture being formed through said attachment portion which aligns with said aperture in said blade holder upon said attachment portion being slidably engaged over said blade holder;

a pull handle assembly pivotally attaching to a distally extending position of said blade holder;

and actuable member including a top surface, a bottom surface, a first side, a second side, a distal end and a proximal end, said actuable member abutting against said bottom surface of said blade holder upon assembly of said handle top and bottom, said actuable member including an elongated recess formed in said top surface, said recess including a substantially teardrop shape with a narrowed distal end and a widened proximal end;

a blade retaining member extending from said top surface of said actuable member and engaging through said aligned apertures in said blade holder and blade, said blade retaining member further comprising a substantially spherical member seating within said teardrop shaped recess, said spherical member engaging through said aligning apertures in said blade and said blade holder;

a first elongated and track shaped recess within which said actuable member is received, said handle bottom further comprising at least one additional elongate extending recesses formed within said first track shaped recess and extending to said proximal end;

said actuable member further comprising an elongated aperture extending in a longitudinal direction and at a position proximal to said teardrop recess, said elongated aperture aligning with said at least one additional extending recess in said assembled handle bottom, a coil spring seatingly engaging within said elongated aperture and said additional extending recess; and means for translating said actuable member in a longitudinal direction relative said blade holder and said assembled handle to disengage said blade retaining member from said blade and to permit withdrawal and replacement of said blade.

2. The apparatus according to claim 1, said means for translating said actuable member further comprising a push knob secured to said proximal end of said actuable member and extending through an additional interior recess of said assembled handle and beyond a proximal end thereof.

3. The apparatus according to claim 1, said blade holder further comprising a first elongated side portion extending along said first side and a second elongate side portion extending along said second side, said first and second side portions slidingly receiving therebetween said attachment portion of said blade.

4. The apparatus according to claim 3, said assembleable handle top further comprising an axially extending recess for matingly receiving said blade holder.

5. The apparatus according to claim 1, further comprising aligning holes in said handle top and bottom for receiving threaded fasteners.

6. The apparatus according to claim 1, said pull handle assembly further comprising an elongated cable, a transverse extending pull handle member securing to a proximal end of said cable, a cable holder attaching to a distal end of said cable and being pivotally secured to said blade holder.

7. The apparatus according to claim 6, said blade holder further comprising a hole formed between said top surface and said bottom surface at said distally extending end, said cable holder further comprising transverse bore in alignment with said hole, an annular spacer collar inserting between said aligned hole and transverse bore and an externally threaded fastener engaging through said hole, said spacer and said transverse bore and being secured by a nut to pivotally associate said handle assembly to said blade holder.

* * * * *